United States Patent [19]

Rose

[11] 3,931,621

[45] Jan. 6, 1976

[54] VARIABLE AMPLITUDE TIMED ALARM SYSTEM

[75] Inventor: Charles Frederick Rose, Indianapolis, Ind.

[73] Assignee: RCA Corporation, New York, N.Y.

[22] Filed: Dec. 10, 1973

[21] Appl. No.: 423,455

[52] U.S. Cl. ..... 340/384 E; 325/396; 325/411; 307/251; 340/309.1; 340/328

[51] Int. Cl.[2] ..... G08B 3/00

[58] Field of Search ..... 340/384 E, 328, 309.1; 325/395, 396, 397, 411; 307/141, 251; 179/2 TC

[56] References Cited

UNITED STATES PATENTS

| | | | |
|---|---|---|---|
| 2,930,000 | 3/1960 | Seller | 325/397 X |
| 3,356,949 | 12/1967 | Jones, Jr. | 325/396 |
| 3,544,901 | 12/1970 | Wood | 325/397 |
| 3,559,072 | 1/1971 | Davidson | 325/395 |
| 3,825,836 | 7/1974 | Pyles | 340/384 E X |

*Primary Examiner*—John W. Caldwell
*Assistant Examiner*—William M. Wannisky
*Attorney, Agent, or Firm*—Eugene M. Whitacre; Kenneth R. Schaefer

[57] ABSTRACT

A timed alarm system having an audio signal source coupled to a sound reproducing system by means of a field effect transistor which yields increasing output as its control electrode is biased by a capacitive network thus producing an alarm signal of gradually increasing amplitude. Apparatus for delayed alarm and drowse capabilities is also described.

10 Claims, 2 Drawing Figures

VARIABLE AMPLITUDE TIMED ALARM SYSTEM

Figure 1:
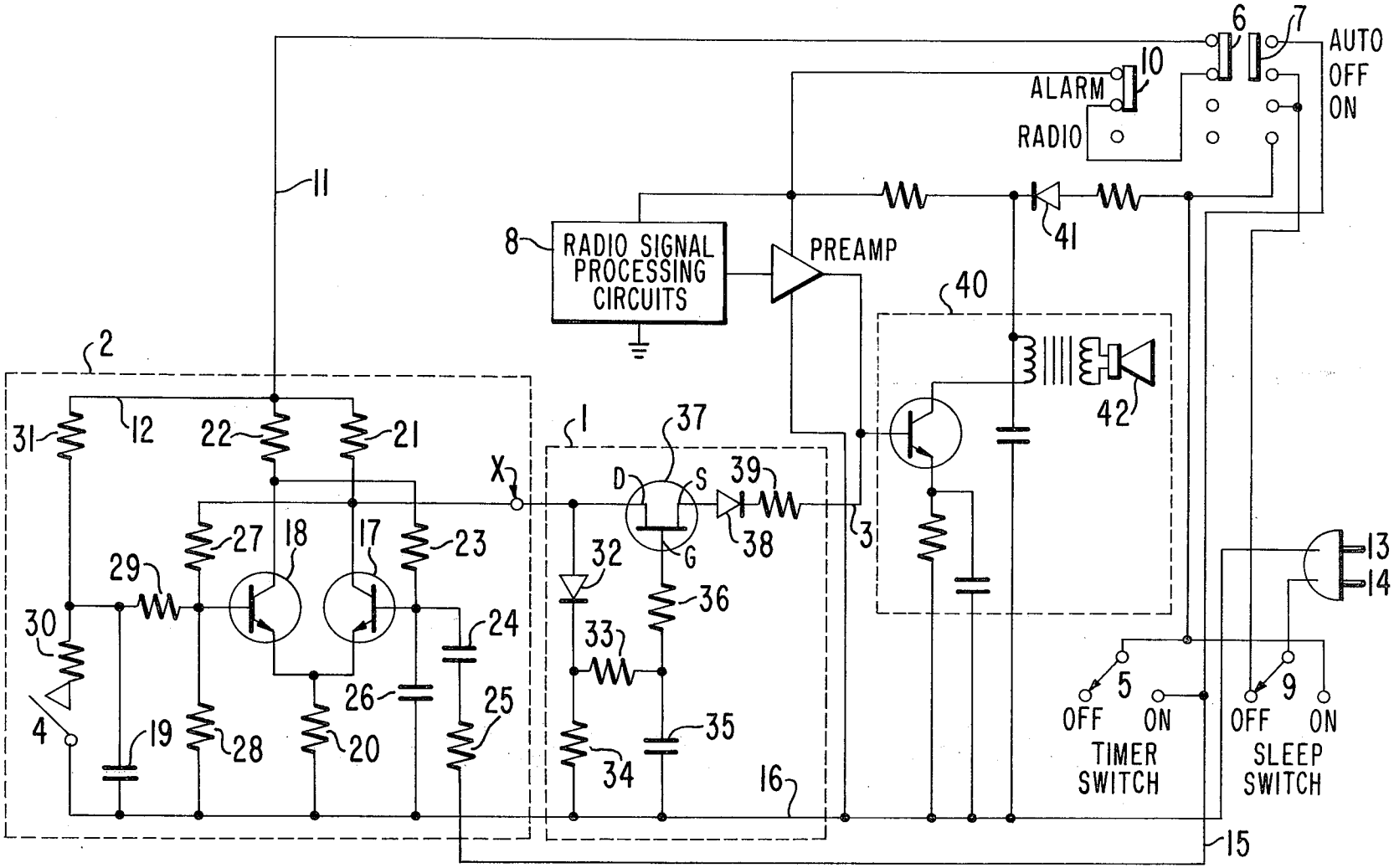

This invention relates to means for controlling the output signal in a timed alarm circuit to achieve an alarm signal of gradually increasing amplitude.

The system to be described contemplates the use of a variable amplitude alarm feature, for example, in a clock radio receiver which also may be provided with a delayed alarm and drowse capability whereby a period of no alarm or subdued alarm, the latter in the form of the radio playing, may precede an alarm of gradually increasing amplitude. A drowse capability also may be provided whereby the alarm condition is interrupted and a period of delayed alarm is recycled. The system also contemplates use in conjunction with electronic clocks and timers.

Most clock radio receivers incorporate devices enabling the operator to be awakened at a predetermined time by means of a manually settable clock timer mechanism which causes the activation of an audible alarm. When the alarm is activated, however, it sound typically at one preset volume level which is characteristic of that particular alarm (usually a relatively loud sound). It is known that a person aroused during a period of deep sleep may find his awakening accompanied by feelings of tiredness and irritableness. This state finds its basis in the fact that the physiological changes of the body function associated with the sleeping state, particularly a lowered basal metabolic rate, are not given sufficient time to readjust to their normal awakened-state level. A stimulus which exceeds one's arousal threshold by only a small degree produces a more desirable, gradual awakening, thereby causing one to be unaware of the fact that he has actually been aroused.

Timed alarm systems which provide a variable amplitude output to produce a pleasant awakening are described in technical literature. Such systems generally employ combinations of mechanical and electromechanical means to achieve the variable amplitude alarm condition. One such system utilizes a variable potentiometer under the control of a clock mechanism whereby as the potentiometer is rotated, an increasing alarm signal voltage is transmitted to a power amplifier and subsequent sound reproducer. Another system employs a thermistor having a negative temperature coefficient of resistance connected in series with an electromechanical vibrator. The thermistor provides a high initial resistance but as electric current causes the thermistor to heat, its resistance gradually decreases. More and more current becomes available for activating the vibrator, thereby producing an alarm signal of increasing amplitude. Still another system employs the combination of a drive motor, drive discs, gears and camming arms, the arrangement of which rotates a volume control shaft to produce the variable amplitude alarm condition. Such systems are considered to be unnecessarily complex and bulky because of the incorporation of mechanical devices.

The alarm system in accordance with this invention provides an awakening comparable to a natural spontaneous one. The alarm system generates a stimulus beginning at low volume which gradually increases up to maximum amplitude.

In accordance with one aspect of the present invention, means are provided in a timed alarm system for coupling an audio signal source to a sound reproducing system to achieve an output signal in the form of a gradually increasing amplitude alarm signal. An active device is employed to control the output alarm signal. Means are provided for biasing a control electrode of this active device to achieve varying levels of conductivity through a main conducting path of the active device. In a particular embodiment, the active device comprises a field effect transistor having a gate for a control electrode and a main conducting path, the gate being responsive to a biasing level to provide variable impedance in the main conducting path. The main conducting path offers a high impedance when the transistor is in its nonconducting state and a low impedance when in its conducting state. A capacitive network, comprising a storage capacitor and a charging impedance provides the gate bias, the capacitor building in charge over a period of time so as to bias the gate electrode to produce gradually increasing conduction through the main conduction path.

In accordance with a further aspect of the present invention, there is provided in a clock radio receiver a clock mechanism for closing an electric alarm circuit at a predetermined time, an audio input signal source, a sound reproducing system, and a subdued alarm circuit which is controlled by the clock mechanism and which couples the signal source at a subdued level to the sound reproducing system at a predetermined time. The system also includes a time delay circuit, the operation of which is initiated by the clock mechanism, a gradually increasing amplitude alarm signal circuit which responds to an output of the delay circuit and thereby couples the signal source to the sound reproducing system initiating an alarm of gradually increasing amplitude; and means for terminating the operation of the gradually increasing alarm circuit.

Figure 2:
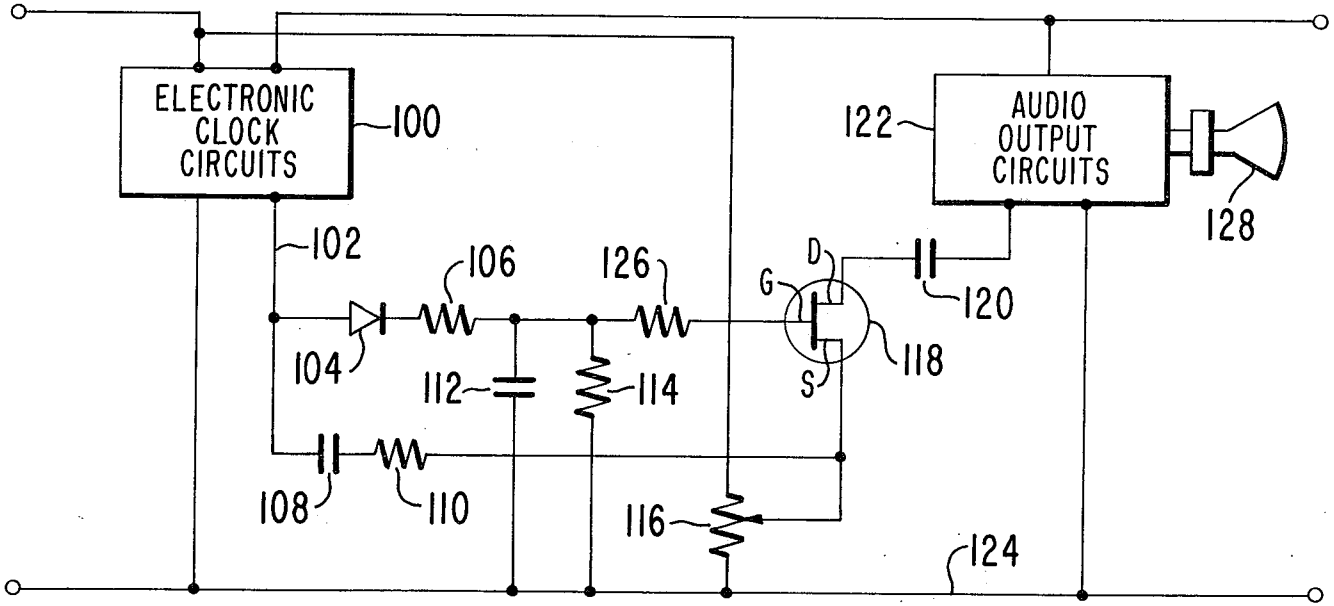

For a better understanding of the present invention, reference should be made to the following description in connection with the drawing in which:

FIG. 1 is a schematic diagram of a portion of a clock radio receiver incorporating circuitry for creating an alarm signal of gradually increasing amplitude along with circuit means for producing delayed alarm and drowse capabilities; and FIG. 2 is a schematic diagram depicting circuit means for embodying the gradually increasing amplitude alarm circuit in an electronic clock apparatus.

Referring to FIG. 1, radio signal processing circuits 8 contains the usual AM or FM R-F mixer, I-F, demodulator and audio circuits, the latter being connected to a sound reproducing system 40. Line voltage rectification to provide operating (B+) voltage is performed by a diode 41, the rectified output of, for example, 9 volts being used not only in the radio circuits 8 but also in a delayed alarm and drowse unit 2 via a circuit path 11.

Unit 2 includes a manual switch 4 by which a delay of alarm activation may be initiated to provide a drowse period, a function which is popularly included in clock radio receivers, such a unit is described in detail in U.S. patent application, Ser. No. 268,787, now U.S. Pat. No. 3,825,836. As will be explained below, at the end of the drowse period, unit 2 delivers an alarm signal via terminal X to a variable alarm unit 1. Unit 1 is arranged to couple an alarm signal of gradually increasing intensity, up to a full alarm condition, which signal is audibly manifested by sound reproducing system 40. Unit 2 is also arranged to provide a period of "subdued alarm" in the form of low amplitude output from radio signal processing circuits 8 prior to the gradually increasing alarm condition.

Referring to delayed alarm and drowse unit 2, transistors 17 and 18 are connected in a trigger scheme designed to produce an alarm signal when predetermined voltage level is produced across a relatively large capacitor 19. Transistors 17 and 18 are connected by a common emitter resistor 20 to a lead 16 which is the common (ground) direct voltage supply line. The collectors of transistors 17 and 18 are supplied from a source of direct current supply voltage at line 12 via collector resistors 21 and 22 respectively. The collector of transistor 18 is coupled via a resistor 23 to the base of transistor 17. A capacitor 24 and a relatively large resistor 25 are coupled in series from the base of transistor 17 to an alternating current source such as the input provided from line cord terminal 14. The collector of transistor 17 (the output transistor) is connected through a resistor 27 to the base of transistor 18 which, in turn, is coupled to common potential line 16 through a resistor 28. Capacitor 19 is also coupled by a resistor 29 to the base of transistor 18.

A relatively fast discharge circuit comprising resistor 30 and drowse switch 4 is provided for capacitor 19. A relatively slow charging circuit is provided for capacitor 19 through a large resistor 31 from supply line 12.

Referring to variable alarm unit 1, a main conduction (drain-source) path of a field effect transistor (FET) 37 is coupled between the output terminal X of the delay circuit 2 and the sound reproducing system 40. The source electrode of FET 37 is coupled to a gating diode 38 and a buffer resistor 39. The gate electrode of FET 37 is connected through a resistor 36 to a charging capacitor 35 which, in turn, is connected to common DC potential line 16.

The series combination of a diode 32 and a resistor 34 is coupled from point X to common direct current line 16. A resistor 33 is coupled from the junction of diode 32 and resistor 34 to the junction of resistor 36 and capacitor 35.

An AUTO-OFF-ON switch with a three-position slider 7 enables the radio signal processing circuits 8 to be turned on for normal or timed play. A sleep switch 9 can be set to automatically switch off the radio after a desired playing time, say one-half hour. A timer switch 5 can be set to switch on the radio unit 8 at a preselected time. A further switch 10 may be set to RADIO if no alarm is desired or to ALARM with its slider in its upper position as shown. The ALARM position will be assumed for the rest of this description. The switch 6 will also be assumed to be in the AUTO position as shown.

Operation of the apparatus is as follows. At the time of closure of timer switch 5, (which action is controlled by an associated clock or timer mechanism which is not shown), direct current supply line 12 is activated in the following manner. Alternating current from supply line 14 passes through switch 9 in the OFF position, through switch 7 in the AUTO position, through switch 5 in the ON position and to diode 41. Diode 41 rectifies the AC input voltage to produce a direct operating voltage. The direct voltage is coupled through switch 10 in the ALARM position, through switch 6 in the AUTO position and finally onto line 11 which provides direct current to supply line 12. The closing of timer switch 5, as will be explained, thus initiates a delay period prior to a gradually increasing alarm condition.

Upon activation of DC supply line 12, the voltage at the junction of capacitor 19 and resistor 29 is zero.

Transistor 18 therefore is non-conductive and the voltage at the collector of transistor 18 is essentially the voltage of direct current line 12. The base current of transistor 17 (which is supplied via resistors 22 and 23) is relatively small and therefore the voltage at the base of transistor 17 is essentially the voltage of direct current line 12. This bias condition switches transistor 17 into saturation conduction.

Since transistor 17 is in saturation, a clipped alternating current signal, supplied from line 14 via the network made up of capacitors 24 and 26 and resistor 25, does not pass beyond the base of transistor 17. With transistor 17 in saturation, the voltage at the collector of transistor 17 is essentially equal to the voltage at the common emitter junction of transistors 17 and 18.

At the same time, capacitor 19 begins charging towards the voltage on line 12 via resistor 31. When the voltage across capacitor 19 exceeds the voltage at the common emitter junction of transistors 17 and 18 by approximately one $V_{be}$, (the forward conduction voltage of the base-emitter of transistor 18) transistor 18 becomes conductive. This change in conduction state pulls the collector of transistor 18 down towards the voltage at the common emitter junction of transistors 17 and 18. This voltage change is coupled through resistor 23 and causes a corresponding voltage drop at the base of transistor 17, which drop causes transistor 17 to come out of its saturated state. The clipped alternating current signal produced at the junction of capacitors 24 and 26 is then amplified by transistor 17 and is coupled into unit 1. The collector of transistor 17, having a higher direct potential than before, tends to maintain capacitor 19 charged, thus enabling transistor 17 to provide a continuous alarm signal (the clipped AC signal) to variable alarm unit 1.

Referring to unit 1, prior to the trigger circuit of unit 2 becoming energized as described above, the direct potential at point X is determined by resistors 21 and 34. Capacitor 35 charges towards a level which is below the voltage at point X by the amount of the voltage drop across diode 32. The circuit parameters (including resistors 20, 21 and 34) are selected so that this voltage level is just below the conduction point of FET 37, which device therefore offers a high resistance in its main current conducting path to the output signal from delayed alarm unit 2 when transistor 17 is saturated.

When the trigger circuit of unit 2 changes state (i.e., transistor 17 comes out of saturation) and flips into its de-energized mode, the potential at point X rises approximately to the potential of the supply at the alarm radio switch 10. This rise in potential causes the junction of diode 32, resistor 33 and resistor 34 to rise in potential to within approximately one diode voltage drop of the supply. Capacitor 35 now begins to charge through resistor 33. This increasing potential is transmitted through resistor 36 to the gate electrode of the field effect transistor 37, which up to this point has been characterized by a high impedance in its main current conducting path (drain-source).

As the potential across capacitor 35 continues to increase, the rise in gate potential causes the main current conducting path of FET 37 to decrease in impedance. This decrease in impedance allows more and more of the modulated alarm signal present at point X and generated from the network of resistor 25, capacitors 26 and 24, and output transistor 17 to pass to the sound reproducing system 40. An alarm tone of gradually increasing amplitude therefore is audibly manifested by speaker 42. The alarm signal continues to gradually increase in amplitude until a full alarm condition is achieved. The delay time constant of this circuit is controlled by the network of resistors 33 and 34 and capacitor 35. The full alarm condition continues until capacitor 19 is discharged. Capacitor 19 can be discharged by (1) manual turn-off of timed switch 5 de-energizing the entire alarm system, (2) switching switch 10 from "ALARM" to "RADIO" to thereby de-energize line 12, and allow capacitor 19 to discharge via associated resistance to ground, (3) switching switch 7 from "AUTO" to "OFF" or "ON" to thereby de-energize line 15 and remove the alarm signal from transistor 17 or (4) operating drowse switch 4 to provide fast discharge of capacitor 19 and thereby provide a renewed delay period when switch 4 is released.

Resistor 34 allows capacitor 35 on the gate of the FET to discharge slowly, thereby making unit 1 compatible with the drowse feature of unit 2. When the drowse function is used, the trigger circuit 17, 18 flips back to saturation conduction of transistor 17 (de-energized state) which allows capacitor 35 to discharge. The time constants of the various parts of the system are selected so that capacitor 35 is discharged before the trigger circuit 17, 18 flips back to the energized state and the alarm signal is generated once again.

Discharge of capacitor 19 switches transistor 18 off, causing its collector to revert back to a voltage close to the voltage of the supply line 12, which again biases the base of transistor 17 to saturation. The base of transistor 17 again effectively shunts the AC input to zero and the alarm signal is terminated.

In a particular embodiment of the invention constructed in accordance with FIG. 1, the following circuit parameters associated with units 1 and 2 are as follows:

| | |
|---|---|
| Resistor 20 | 560 ohms |
| Resistor 21 | 4.7K |
| Resistor 22 | 3.3K |
| Resistor 23 | 120K |
| Resistor 25 | 4.7M |
| Resistor 27 | 120K |
| Resistor 28 | 22M |
| Resistor 29 | 56K |
| Resistor 30 | 10 ohms |
| Resistor 31 | 820K |
| Resistor 33 | 68K |
| Resistor 34 | 3.3M |
| Resistor 36 | 15M |
| Resistor 39 | 10 ohms |
| Capacitor 19 | 1000mf |
| Capacitor 24 | .0047mf |
| Capacitor 26 | .0047mf |
| Capacitor 35 | 100mf |

Referring to FIG. 2, circuit means are depicted for embodying the gradually increasing amplitude alarm circuit in an electronic clock apparatus of the type, for example, which are commercially available from Mostek Corporation and are designated as MK5017ANP. Such clock circuits, in addition to providing timing functions by means of digital electronic circuits, also include tone signal generating apparatus, the latter being connected to a sound reproducing system 122. The main conduction path (drain-source) of a field effect transistor (FET) 118 is coupled between the wiper of a variable resistor 116 and the sound reproducing system 122. The drain electrode of FET 118 is coupled to an isolation capacitor 120. The series combination of a capacitor 108 and a resistor 110 is coupled fron tone line 102 to the source electrode of FET 118. The parallel combination of a capacitor 112 and a resistor 114 is coupled from the junction formed by resistor 106 and the gate electrode of FET 118 to common line 124. The series combination of a diode 104 and a resistor 106 is coupled from the junction formed by capacitor 112 and resistor 114 to the junction formed by capacitor 108 and tone line 102. A resistor 126 is connected between the gate electrode of FET 118 and the junction formed by capacitor 112 and resistor 114.

Operation of the apparatus of FIG. 2 is as follows. Electronic clock circuits 100 embodies an integrated circuit chip which contains circuits to include a timer, sleep counter, drowse counter, decoder, alarm generator, multiplexer, etc., for providing various clock-radio operations. At a predetermined time selected by the user, the time register of the chip will match the counterpart alarm register thereby activating the alarm pin on the chip. The alarm circuit of the integrated circuit chip then generates a modulated alarm tone which, through the chip alarm pin, is fed to tone line 102. The modulated alarm tone is then rectified and filtered by diode 104, resistor 106 and capacitor 112 to produce a gradually increasing gate bias for FET 118. Resistor 126 serves to isolate the gate of FET 118 from capacitor 112. Variable resistor 116 is provided to set the conduction point of FET 118.

Upon activation of the alarm circuit, the alarm tone is transmitted via path 102 to capacitor 108 where the direct current component is isolated from the tone signal. Resistor 110 couples the alarm tone signal to the source of FET 118. FET 118 up to this point has been characterized by a high impedance in its main current conducting path (drain-source).

As the potential across capacitor 112 continues to increase, this rise in potential causes the main current conducting path of FET 118 to decrease in impedance. This decrease in impedance allows more and more of the modulated alarm signal present at the source of FET 118 to pass to the sound reproducing system 122. An alarm tone of gradually increasing amplitude, therefore, is audibly manifested by speaker 128. The alarm signal continues to gradually increase in amplitude until a full alarm condition is achieved. The time constant of this system is controlled by the network of resistor 106 and capacitor 112. Resistor 114 allows capacitor 112 to discharge slowly during the alarm off-time so as to provide a fully discharged capacitor 112 when the alarm circuit is re-activated.

Preferred values of the various parameters concerned with FIG. 2 are as follows:

| | |
|---|---|
| Resistor 106 | 680K |
| Resistor 110 | 4.7K |
| Resistor 114 | 2.7M |
| Resistor 116 | 500K |
| Resistor 126 | 100K |
| Capacitor 108 | .047mf |
| Capacitor 112 | 10mf |
| Capacitor 120 | .047mf |

Additional functions may be provided by the variable alarm control circuit shown in the figures. For example, with minimal circuit modifications, a gradually increasing volume of the radio audio output instead of the clipped alternating current line waveform or the tone generator of FIG. 2 may be employed to achieve awakening. The subdued alarm from the switched on radio is not necessary to all aspects of the invention. The clock timer may be digital, analog or mechanically operated. The delayed alarm and drowse circuitry is not essential to the variable intensity alarm aspects of the invention which may be used alone and in such embodiments as the all-electronic clock or electronic alarm systems to include all-electronic timers. Other alternatives or improvements will occur to persons of ordinary skill.

What is claimed is:

1. A timed alarm system comprising:

a. an audio signal source;

b. a sound reproducing system; and c. means for coupling said signal source to said sound reproducing system comprising:

1. an active device having a control electrode and a main current conduction path;
2. a charge storage device coupled to said control electrode;
3. means operable to discharge said storage device;
4. means for charging said storage device at a predetermined rate; and
5. switching means for coupling said storage device to said charging means, said rate of charging being selected such that a voltage developed at said control electrode will render said main current path of said active device continuously and gradually increasingly conductive thereby coupling said audio source to said sound reproducing system to produce an audio alarm signal which automatically increases in a continuous and gradual manner as said storage device charges following operation of said switching means.

2. The timed alarm system as defined in claim 1 wherein said active device is a field effect transistor having a gate as a control electrode and a main conducting path, said transistor being responsive to a bias level at said gate for providing a variable impedance in said main current path.

3. The timed alarm system as defined in claim 2 wherein said charge storage device is a storage capacitor coupled to the gate electrode of said field effect transistor, said capacitor building in charge over a period of time so as to bias said gate electrode to produce gradually increasing conduction through said main conduction path.

4. The timed alarm system as defined in claim 3 wherein means for charging said capacitor includes a resistor coupled to the gate of said field effect transistor for causing said capacitor to build a charge over a period of time so as to bias said gate electrode to provide gradually increasing conduction by said transistor.

5. The timed alarm system as defined in claim 4 wherein said audio signal source provides a direct current component and an alternating current component and said source further comprises rectification means to provide a direct current signal for charging said capacitor.

6. In a timed alarm system the combination comprising:

a. a timer mechanism having means for energizing an electric alarm circuit at a predetermined time;

b. means for providing an operating potential;

c. radio signal processing circuits for providing an audio input signal source;

d. a sound reproducing system;

e. a subdued alarm circuit energized by said timer mechanism at said predetermined time for coupling said audio signal source at a subdued level to said sound reproducing system;

f. a time delay circuit the operation of which is initiated by said timer mechanism;

g. a gradually increasing amplitude alarm signal circuit responsive to an output of said delay circuit for coupling said operating potential to said sound reproducing system for producing an alarm of increasing amplitude up to a full alarm condition and for coupling said alarm to said sound reproducing system; and h. means for terminating the operation of said gradually increasing alarm circuit.

7. The combination as defined in claim 6 wherein said gradually increasing alarm circuit comprises an active device having a control electrode, a network with a capacitor coupled to said control electrode and a source of charging current for said capacitor so arranged that the amplitude of the alarm varies in accordance with a change in voltage across said network, said network further including discharge means coupled to said capacitor such that said capacitor is discharged when the alarm circuit initially becomes operable and gradually increases in charge over a period of time, the increasing charge causing a progressively increasing amplitude alarm.

8. The combination as defined in claim 6 wherein said gradually increasing alarm circuit comprises a field effect transistor having a gate electrode coupled to a capacitive network and a charging supply coupled to said network for producing a change in voltage across said network which in turn produces a corresponding change in the transistor conduction, said transistor gradually increasing conduction over a period of time to progressively increase the amplitude of the alarm.

9. The combination as defined in claim 6 wherein said gradually increasing amplitude alarm signal circuit comprises a signal source having an alternating current component and a direct current component, a field effect transistor having a control electrode and a main current conducting path, a capacitive network including a capacitor and a resistor for biasing the control electrode of said transistor to enable said main current conducting path to become gradually increasingly conductive, a diode for rectifying signal components provided from said signal source to produce a direct current signal component for charging said capacitor, and a radio loudspeaker to audibly manifest said passage of alternating current tone for gradually increasing amplitude alarm condition.

10. The combination as defined in claim 6 wherein the means for terminating the gradually increasing alarm condition comprises a manually operable renew switch effective to terminate the increasing alarm condition and to initiate and recycle both the short delay and subdued alarm generating circuit followed by the gradually increasing amplitude alarm condition.

* * * * *